United States Patent [19]

Egloff et al.

[11] Patent Number: 4,807,670

[45] Date of Patent: Feb. 28, 1989

[54] GIVER FOR A GRIPPER LOOM

[75] Inventors: Anton Egloff, Jona; Lothar Kohler, Tann-Ruti, both of Switzerland; Franco Bianchi, Villaguardia, Italy

[73] Assignee: Sulzer Brothers Limited, Winterthur, Switzerland

[21] Appl. No.: 119,587

[22] Filed: Nov. 12, 1987

[30] Foreign Application Priority Data

Nov. 19, 1986 [CH] Switzerland ..... 625/86

[51] Int. Cl.[4] ..... D03D 47/18

[52] U.S. Cl. ..... 139/448

[58] Field of Search ..... 139/447, 448

[56] References Cited

U.S. PATENT DOCUMENTS 4,587,998 5/1986 Egloff et al. ..... 139/448

FOREIGN PATENT DOCUMENTS 3003105 8/1980 Fed. Rep. of Germany ..... 139/448

*Primary Examiner*—Henry S. Jaudon

*Attorney, Agent, or Firm*—Kenyon & Kenyon

[57] ABSTRACT

The giver is used with a gripper loom having a stationary weft supply and includes a tongue in the gripper casing and a clamping element on a wide side of tongue so devised that clamping element bears to some extent on the underside of the gripper casing. At the entry and clamping zone of the yarn, the clamping element takes the form of a thin flat spring strip which follows the curvature of the tongue and which is secured thereto at one end while at a central region the clamping element presses a clamping surface of the gripper casing. When a member moves the tongue away from the gripper casing, the clamping element also disengages from the clamping surface, so that dirt between the clamping surfaces of the tongue element and casing can drop away or be extracted.

8 Claims, 3 Drawing Sheets

GIVER FOR A GRIPPER LOOM

This invention relates to a giver for a gripper loom having a stationary weft supply.

As is known, as gripper looms come to be used in new areas, the requirements made, more particularly, on the gripper elements responsible for picking are increasing since the production of special fabrics calls for the processing of very thin and smooth and, to some extent, elastic yarns. Heretofore, givers have been constructed with a gripper casing in which a clamping tongue is positioned for clamping a yarn between the tongue and a surface of the casing, for example, with a wedge-shape gap between the clamping tongue and the gripper casing being sufficient to clamp a yarn fast for processing a wide range of yarns. However, additional elements have been required for some yarns in order to ensure reliable picking.

Swiss Pat. No. 634,615 describes a giver in which an additional clamping element is secured to the underside of the clamping tongue in order to retain a yarn on the underside of the clamping tongue in addition to retaining the yarn in the clamping gap between the tongue and the additional element. Thus, when a weft yarn enters the giver, the yarn is first engaged between the wide sides of the clamping tongue and the additional clamping element and then moves further into the gripper casing wherein the yarn ends up being firmly retained between a narrow side of the clamping tongue and a corresponding edge in the gripper casing until being released from this position in the center of a loom by the taker. After the giver returns to an initial position to receive a further weft yarn, the clamping tongue is pressed downwardly while the giver is in a rearmost position so that deposits sticking between the tongue and the gripper casing can be removed by scraping or suction. However, since the additional clamping element disengages from the gripper casing along with the clamping tongue, deposits between the tongue and the additional clamping element cannot be removed. Further, these deposits can be yarn fibers or sizing material for the yarns and can fill up the gap between the tongue and the clamping element to an extent such that the clamping element cannot engage directly on the tongue. In this event, the clamping element is only able to provide two right-angled deflections of the weft yarn without being able to retain the weft yarn so that yarns cannot then be picked.

Accordingly, it is an object of the invention to provide an improved giver construction for handling various types of weft yarns.

It is another object of the invention to avoid excessive deposits in the weft yarn clamping zones of a giver.

It is another object of the invention to provide a giver having a tongue and an additional clamping element which can be readily cleaned.

Briefly, the invention provides a giver for a gripper loom having a stationary weft supply wherein the giver comprises a gripper casing, a tongue mounted in the casing for clamping a weft yarn therebetween and a clamping element secured to the tongue and disposed in facing relation to an underside of the casing to clamp the weft yarn therebetween.

The tongue may be constructed in a conventional fashion, for example, with a curved portion facing a clamping edge of the casing in order to define a yarn entry and clamping zone. The clamping element takes the form of a thin flat spring in the weft entry and clamping zone while following the curvature of the tongue. Still further, the tongue may be provided with a clamping edge which faces the casing and which is also spaced from an adjacent edge of the clamping element in order to define a narrow gap of substantially constant width therebetween. This gap leaves free the zone in which the weft yarn is clamped between the tongue and the gripper casing. This is important for adjustment of the giver since the gap enables the position of the yarn in a wedge-shaped gap between the tongue and the gripper casing to be better controlled by the operatives.

The clamping element is secured at a proximal end by suitable means to the tongue while being biased against a clamping surface on the underside of the casing at a central region.

The clamping element enables delicate and smooth weft yarns to be worked gently and yet reliably and obviates disturbances due to deposits arising between the clamping surfaces.

These and other objects and advantages of the invention will become more apparent from the following detailed description taken in conjunction with the accompanying drawings wherein.

Figure 1:
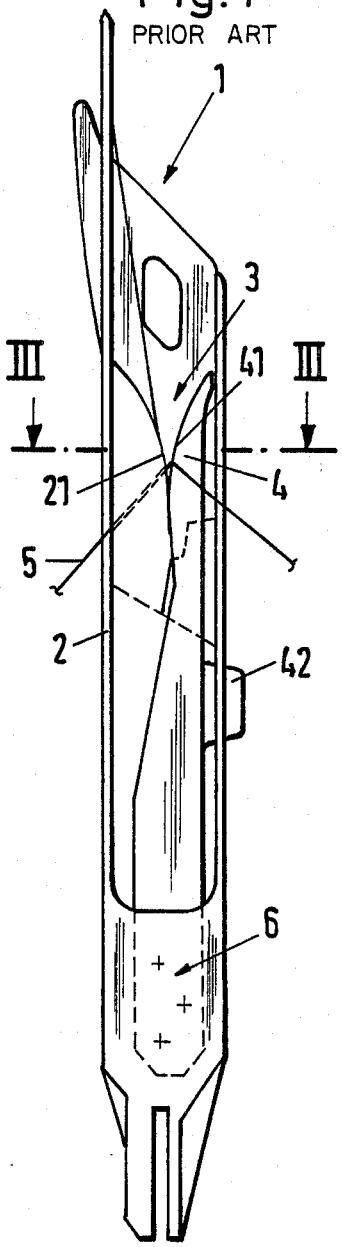
Fig. 1 PRIOR ART
FIG. 1 illustrates a bottom view of a conventional giver of the prior art.

Referring to FIG. 1, the giver 1 which is of generally known construction has a gripper casing 2 provided with a clamping edge 21 along a curved surface. In addition, the giver 1 includes a tongue 4 which is mounted in the casing 2 in facing relation to the clamping edge 21 in order to clamp a weft yarn 5 therebetween. As indicated, the tongue 4 can be secured to the casing 2 by any suitable means such as a screwed fastening 6.

Figure 2:
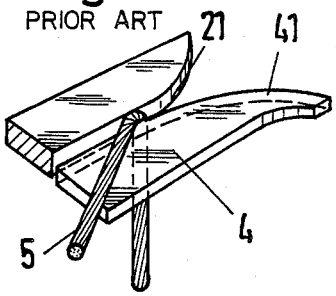
Fig. 2 PRIOR ART
FIG. 2 illustrates a perspective view of a clamping zone of the giver of FIG. 1.

As indicated in FIG. 2, the tongue 4 has a clamping surface 41 of curved shape facing the clamping edge 21 of the casing.

Figure 3:
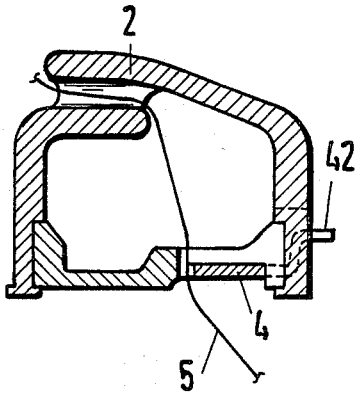
Fig. 3 PRIOR ART
FIG. 3 illustrates a view taken on line III—III of FIG. 1.

When in use, a weft yarn 5 which is taken up initially slides into a top part of the giver as indicated in FIG. 3. the weft yarn is then retained in the bottom part between the clamping edge 41 of the tongue 4 and the clamping edge 21 of the casing 2 after the yarn has been positively guided through a wedge shaped gap 3 (see FIG. 1). When the giver 1 returns to an initial position before receiving a weft yarn, a member 42 which projects from the tongue 4 through the casing 2 strikes an overhead abutment (not shown) so that the tongue 4 is pressed downwardly, as viewed in FIG. 3 out of the casing 2. Deposits between the clamping edges 21, 41 may then be scraped off these edges.

Figure 4:
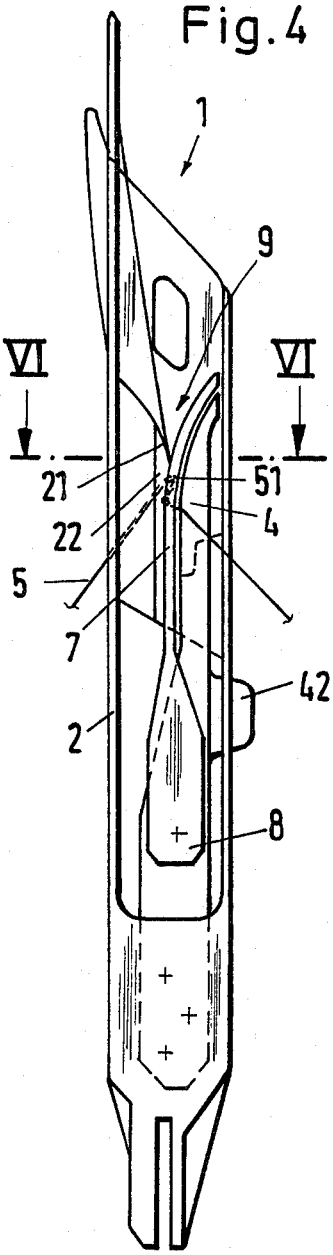
FIG. 4 illustrates a bottom view of a giver constructed in accordance with the invention.
Figure 5:
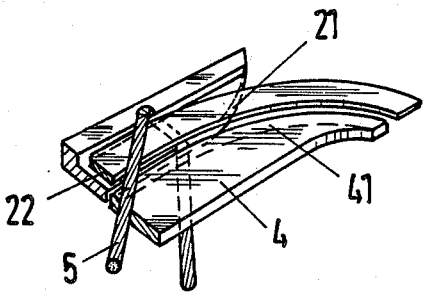
FIG. 5 illustrates a perspective view of a clamping zone of the giver of FIG. 4.

Referring to FIG. 4, wherein like reference characters indicate like parts as above, the giver 1 includes an additional clamping element 7 which is secured to the tongue 4 at a proximal end, for example by means of a screw 8. In addition, the gripper casing 2 is provided with a recessed clamping surface 22 to receive the clamping element 7 in spaced relation.

Figure 6:
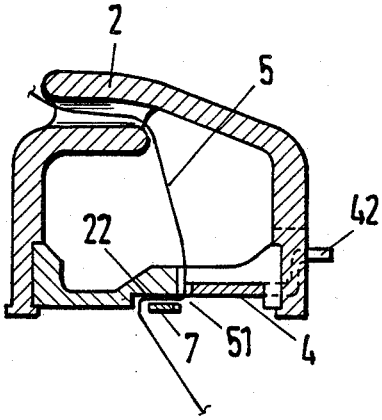
FIG. 6 illustrates a view taken on line VI—VI of FIG. 4.

As indicated in FIG. 4, the tongue 4 has a curved portion facing the clamping edge 21 of the casing to define a yarn entry and clamping zone. The clamping element 7 follows the curvature of the tongue and is in the form of thin flat spring strip in the entry and clamping zone. In addition, the clamping edge 41 of the tongue 4 is spaced from an adjacent edge of the clamping element 7 in order to define a narrow gap 51 of substantially constant width therebetween (see FIGS. 4 and 6).

When the giver 1 receives the weft yarn 5, the yarn 5 slides initially into a wedge-shape gap 9 bounded by the clamping edge 21 of the casing 2 and the clamping element 7. Thereafter, the weft yarn is clamped between the clamping surface 22 of the casing 2 and the top of the clamping element 7 (see FIG. 6). The clamping element 7 bears against the clamping surface 22 due to its own reduced biasing.

As the giver 1 continues to advance, the weft yarn can slip further behind until being secured in a position 51 (see FIG. 4) between the tongue 4 and the clamping edge 21. The weft yarn remains in the this position until the taker (not shown) removes the yarn from the giver 1.

Thus, the clamping tongue 4 presses the yarn against the clamping edge 21 of the casing 2 and the clamping element 7 presses the weft yarn on the clamping surface 22 of the casing. The yarn is thereby deflected twice through a right angle near the clamping edges or clamping surface as can be determined from FIG. 6.

As with a conventional giver, the tongue 4 carries a means for biasing the tongue and clamping element out of the casing to permit cleaning of deposit from between the tongue 4 and the casing 2. As indicated, the means is in the form of a member 42 which extends from the tongue 4 out of the casing 2 to permit deflection of the tongue 4 and the clamping element 7 out of the casing 2.

When the member 42 is depressed, the tongue 4 is pressed downwardly so that the clamping edge 41 disengages from the edge 21 of the casing 2. Simultaneously, the clamping element 7 moves away from the clamping surface 22 of the casing 2 since the element 7 is secured to the tongue 4. When the giver 1 is in the most rearward position, an extraction device (not shown) comes into operation and produces a flow of air through the casing 2 and the clamping zones to remove deposits, for example of fluff while the tongue 4 and element 7 are in the disengaged position.

Figure 7:
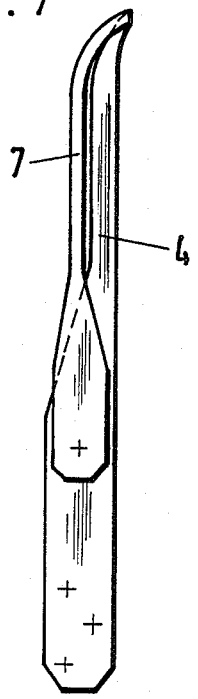
FIG. 7 illustrates a view of a modified tongue and clamping element arrangement in accordance with the invention.

Referring to FIG. 7, wherein like reference characters indicate like parts as above, the tips of the tongue 4 and clamping element 7 may substantially coincide with one another when the parts are assembled.

In order to vary the pressure with which the clamping element 7 engages with the clamping surface 22, the element 7 may be deformed near a shaft considerably in relation to the plane in which the tongue 4 is disposed. This adjustment enables the element 7 to be adapted to different yarns.

The invention thus provides a giver which can be utilized with a wide range of yarns and particularly for very thin and smooth yarns and with elastic yarns.

What is claimed is:

1. A giver for a gripper loom having a stationary weft supply, said giver comprising
   - a gripper casing;
   - a tongue mounted in said casing for clamping a weft yarn therebetween; and
   - a clamping element secured at a proximal end to said tongue and biased in facing relation to a clamping surface on a central region of an underside of said casing to clamp the weft yarn between said surface and the top of said clamping element.

2. A giver as set forth in claim 1 wherein said tongue has a curved portion facing a clamping edge of said casing to define a yarn entry and clamping zone and said clamping element is in the form of a thin flat spring strip in said zone while following the curvature of said tongue.

3. A giver as set forth in claim 2 wherein said tongue has a clamping edge facing said casing and spaced from as adjacent edge of said clamping element to define a narrow gap of substantially constant width therebetween.

4. A giver for a gripper loom having a stationary weft supply, said giver comprising
   - a gripper casing having a clamping edge;
   - a tongue mounted in said casing in facing relation to said clamping edge to clamp a weft yarn therebetween;
   - a clamping element secured to said tongue at a proximal end and having an edge spaced from an adjacent edge of said tongue to define a gap therebetween, said clamping element being disposed in facing relation to an underside of said casing to clamp the weft yarn between said clamp and the top of said clamping element; and
   - means for biasing said tongue and said clamping element out of said casing to permit cleaning of deposits from between said tongue and said casing.

5. A giver as set froth in claim 4 wherein said casing includes a clamping surface extending from said clamping edge in facing relation to said clamping element.

6. A giver as set forth in claim 5 wherein said means is a member extending from said tongue and out of said casing to permit deflection of said tongue and said clamping element out of said casing.

7. A giver as set forth in claim 4 wherein said clamping element is a thin flat spring strip.

8. A giver as set forth in claim 4 wherein said clamping element is secured at a proximal end to said tongue and is biased against a clamping surface on said underside of said casing at a central region.

* * * * *

UNITED STATES PATENT AND TRADEMARK OFFICE

CERTIFICATE OF CORRECTION

PATENT NO. : 4,807,670

DATED : February 28, 1989

INVENTOR(S) : ANTON EGLOFF, ET AL

It is certified that error appears in the above-identified patent and that said Letters Patent is hereby corrected as shown below:

Column 1, line 48 "that yarns" should be -that some yarns-
Column 2, line 55 "the weft" should be -The weft-

Signed and Sealed this

Twenty-eighth Day of November 1989

*Attest:*

JEFFREY M. SAMUELS

*Attesting Officer* *Acting Commissioner of Patents and Trademarks*